United States Patent [19]

Füssinger et al.

[11] Patent Number: 4,920,595

[45] Date of Patent: May 1, 1990

[54] SOLID BRIDGE KIT

[75] Inventors: Reinhold Füssinger, Friedrichshafen; Friedrich Graf, Daisendorf, both of Fed. Rep. of Germany

[73] Assignee: Dornier System GmbH, Friedrichshafen, Fed. Rep. of Germany

[21] Appl. No.: 613,756

[22] Filed: May 24, 1984

Related U.S. Application Data

[63] Continuation-in-part of Ser. No. 418,065, Sep. 4, 1982, abandoned.

[30] Foreign Application Priority Data

Sep. 30, 1981 [DE] Fed. Rep. of Germany ..... 3138853

[51] Int. Cl.[5] ..... E01D 15/12

[52] U.S. Cl. ..... 14/2.4; 14/17

[58] Field of Search ..... 14/2.4, 2.6, 27, 1, 14/5, 14, 13

[56] References Cited

U.S. PATENT DOCUMENTS

| | | | |
|---|---|---|---|
| 3,490,605 | 1/1970 | Koss | 14/1 X |
| 3,492,683 | 2/1970 | Wagner et al. | 14/2.4 |
| 3,594,840 | 7/1971 | Loustalet et al. | 14/1 |
| 3,651,528 | 3/1972 | Behrmann et al. | 14/1 |
| 4,073,025 | 2/1978 | Peckham | 14/2.4 |
| 4,262,381 | 4/1981 | Blink et al. | 14/27 X |
| 4,288,881 | 9/1981 | Mahncke et al. | 14/2.4 |
| 4,319,375 | 3/1982 | Mahncke | 14/2.4 |
| 4,521,932 | 6/1985 | Parramore | 14/2.4 |

FOREIGN PATENT DOCUMENTS

| | | | |
|---|---|---|---|
| 2477599 | 9/1981 | France | 14/2.4 |
| 2039311 | 8/1980 | United Kingdom | 14/2.4 |

*Primary Examiner*—Jerome W. Massie, IV
*Assistant Examiner*—Matthew Smith
*Attorney, Agent, or Firm*—Ralf H. Siegemund

[57] ABSTRACT

An improved dry bridge kit, composed of individual bridge bays of cross-sectional U-shape and of a cross-sectionally H-shaped traversing beam, the improvement comprising that the bridge bays are composed of a central part and of two side parts, the side parts containing hollow parallelipipedic track ways, and being foldable for transport underneath the central part. When launching the bridge, first the traversing beam is assembled and launched and then the individual bridge segments are coupled together and moved over the tranversing beam. The traversing beam remains as a bridge support element.

16 Claims, 10 Drawing Sheets

SOLID BRIDGE KIT

This application is a continuation-in-part, of application Ser. No. 418,065, filed 09-04-82 now abandoned.

This invention concerns a solid or dry bridge kit for temporarily spanning waters or terrain depressions.

Such bridges are primarily used by military engineers where natural obstacles exceeding about 20 meters prevent further motion by land vehicles and where the span of simple tank folding bridges does not suffice.

Engineer's bridges such as the Medium Girder Bridge of Fairey (Great Britain) are known, which consist of many small elements to be assembled manually.

These small elements offer the advantage of good storage, but they have the drawback that assembly is labor and time intensive due to the many manual operations.

The FESTBRUECKE TYPE B ("Dry Bridge Type B") of the Krupp organization consists of larger but still very numerous parts. In addition to a crane, assembly still requires numerous manual operations.

As regards the BRUECKE 80 ("Bridge 80") of Dornier System GmbH, the emplacement labor is minimized by using fewer but larger parts. However these large individual parts cause a transportation problem. Thus, the transport vehicles which are four meters wide are banned from the roads and are practical on open terrain only under certain conditions.

The transport vehicles of the British MACH/ABLE bridge (designed by MVEE) are three meters wide, but still excessive. Another drawback is the relatively many crane motions required on the assembly site to assemble the bridge from track supports and cross members.

There is no bridge in the state of the art which can be both rapidly assembled and transported in a problem-free manner.

It is the object of the invention to provide a dry bridge in kit form, which permits transportation over roads and terrains and nevertheless can be put in place rapidly by only a few personnel.

This bridge offers the following advantages:

- it can be launched using extant equipment (BIBER tracked launcher),
- rapid assembly and dismantling due to using large components,
- low personnel requirements,
- high stability due to outside trackways,
- low loading sizes: 2.5 m width, 3.5 m height for an approximately 14 meter bridge with a travel track of 4 m width,
- automatic unfolding and collapsing,
- cable reinforcement for higher effective loads or spans, is easy to clean, in part self-cleaning,
- launching completely from one side, without requiring personnel on the other,
- can be dismantled from either side, without having to move components from the assembly side to the dismantling side, and
- low space requirements at the bank, both in the direction of the obstacle and perpendicularly thereto.

The invention will be further illustrated by reference to the accompanying drawings, in which.

Figure 3:
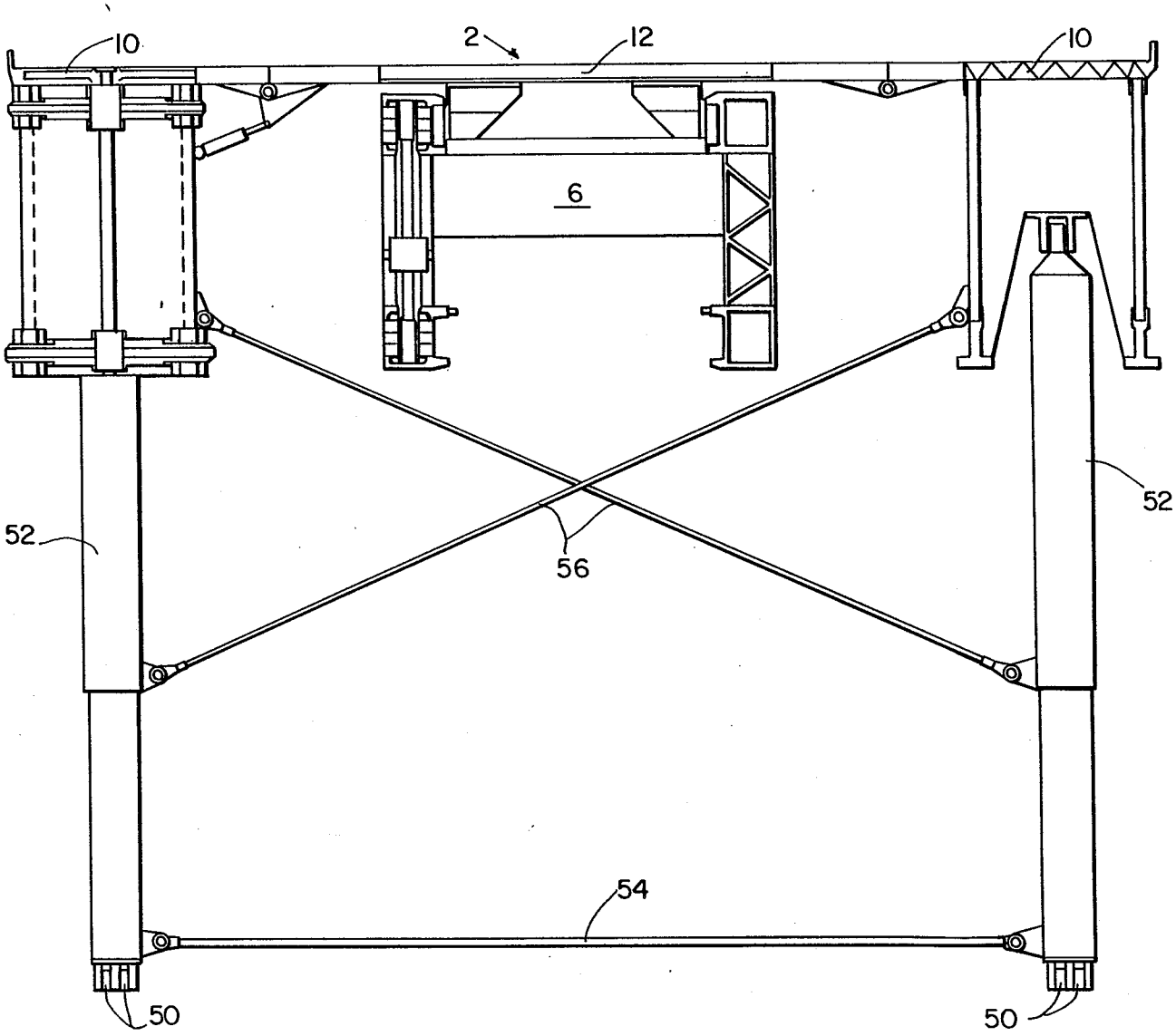
Figure 4:
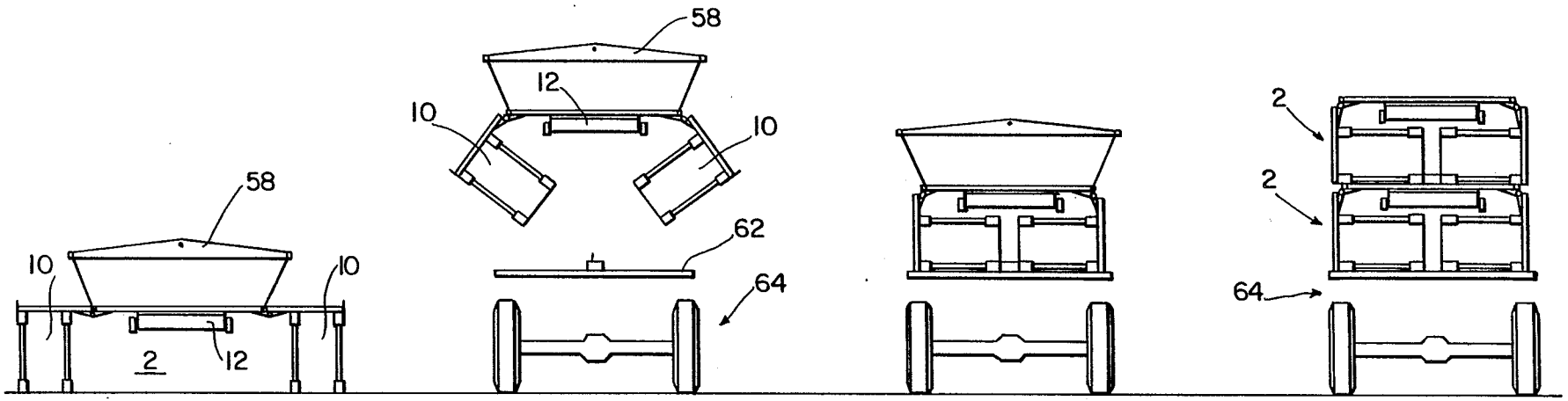
Figure 5:
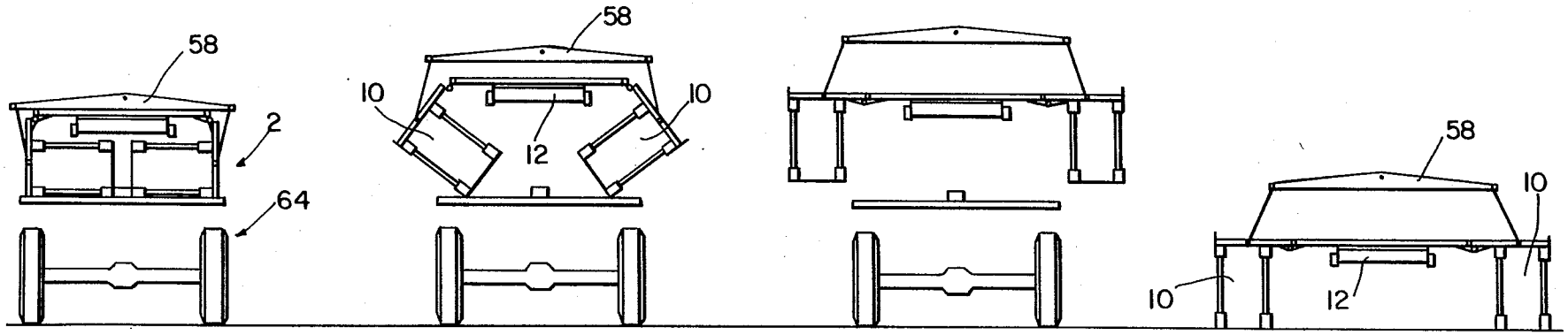
Figure 6:
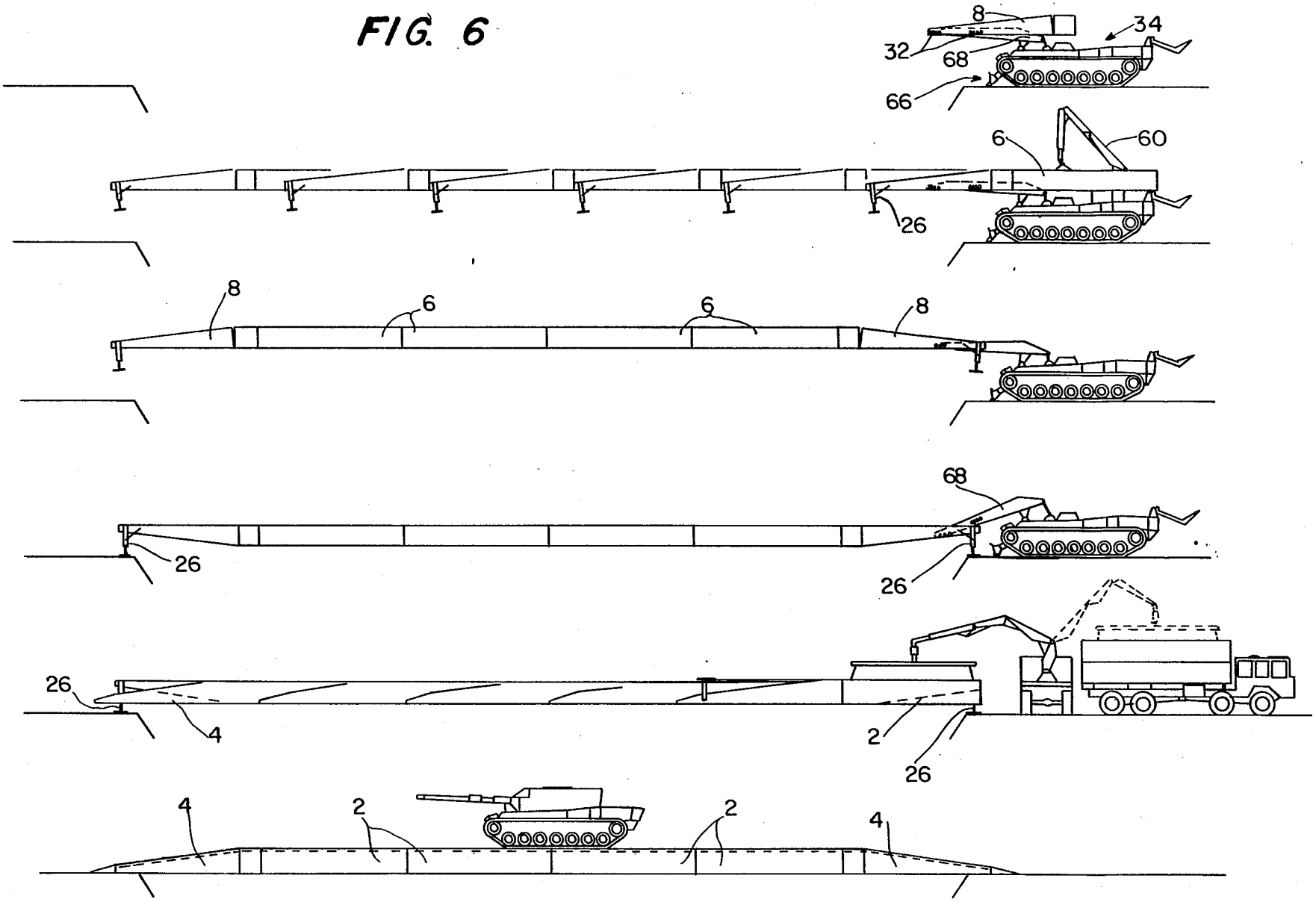
Figure 7:
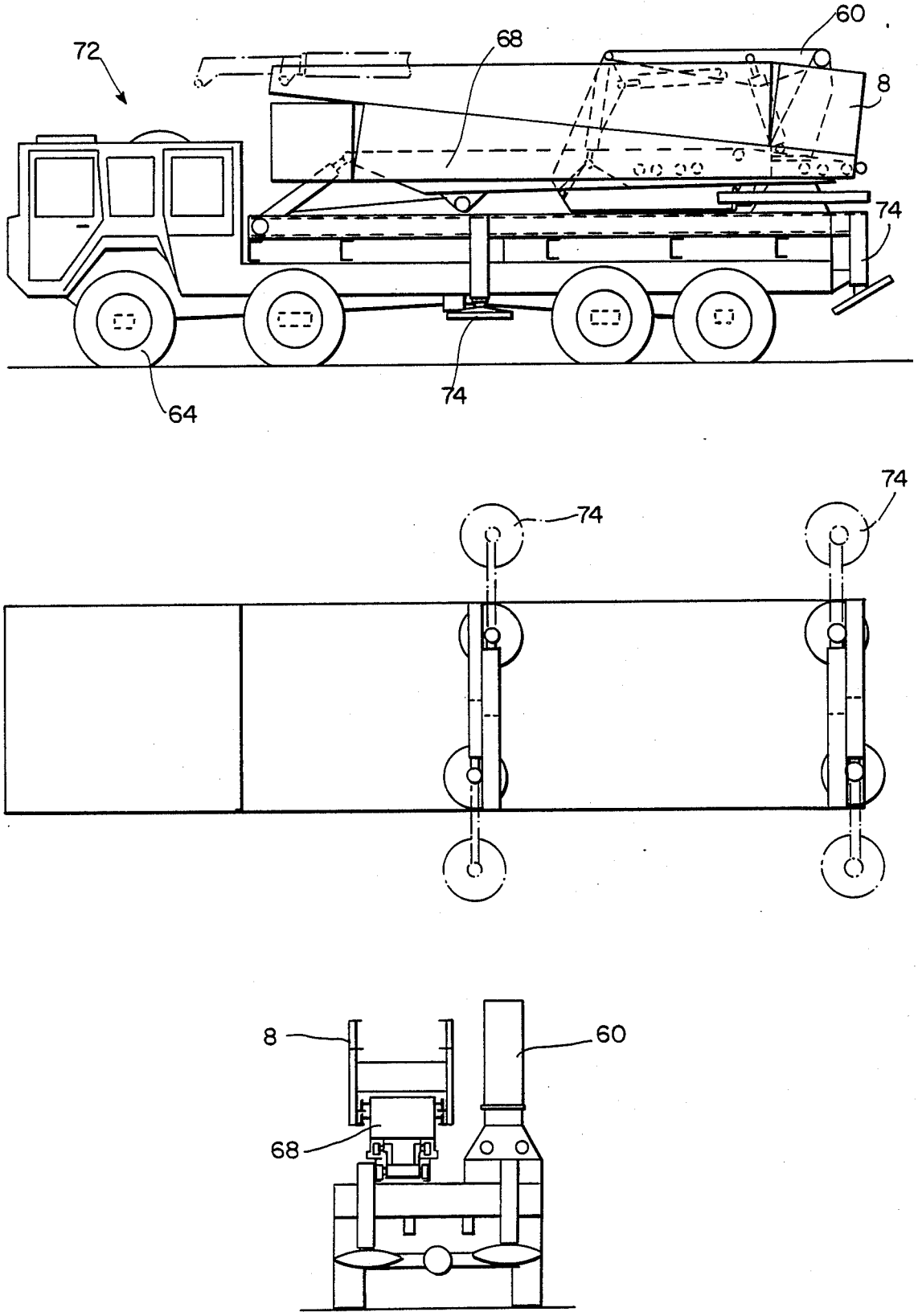
Figure 8:
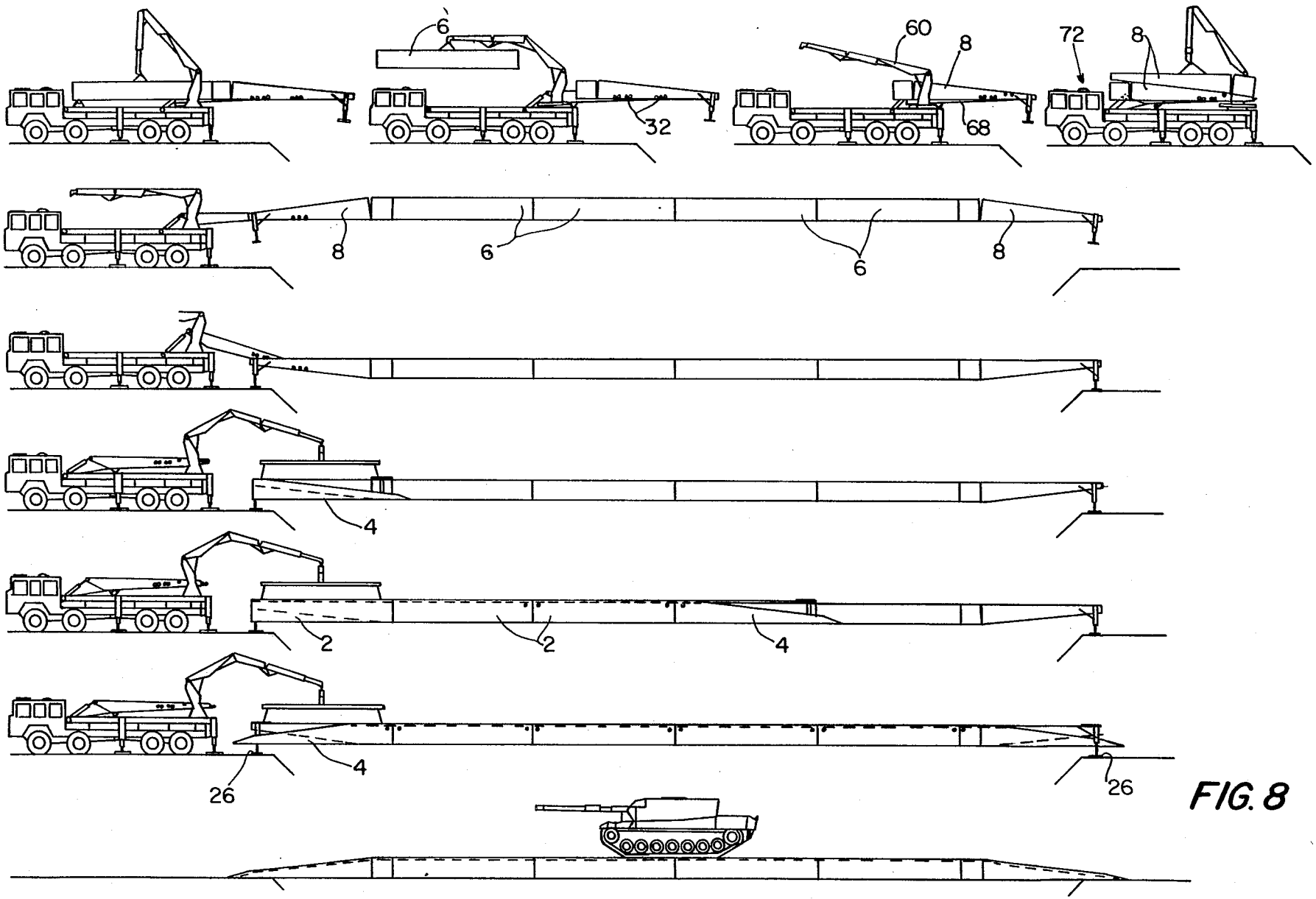
Figure 9:
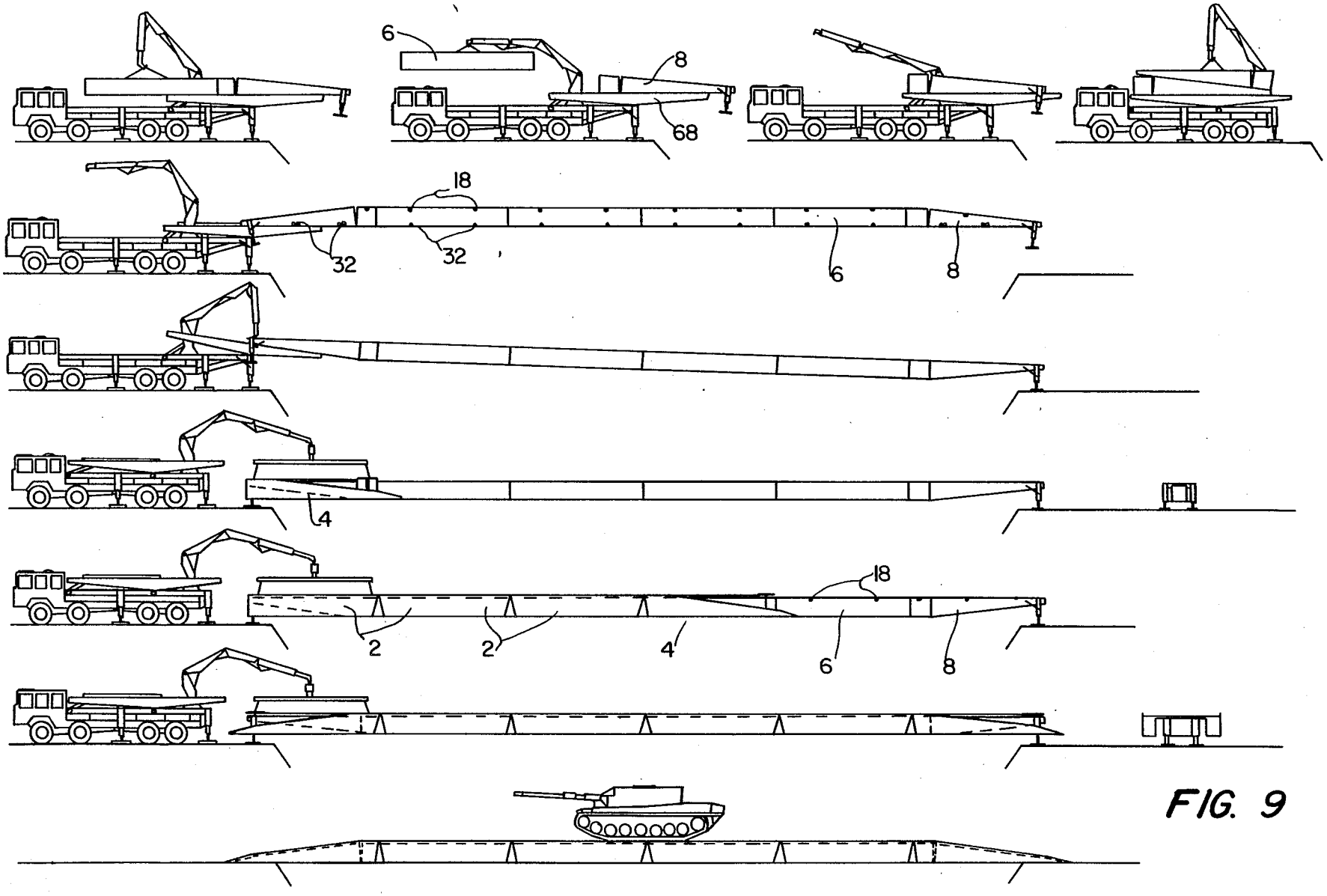
Figure 10:
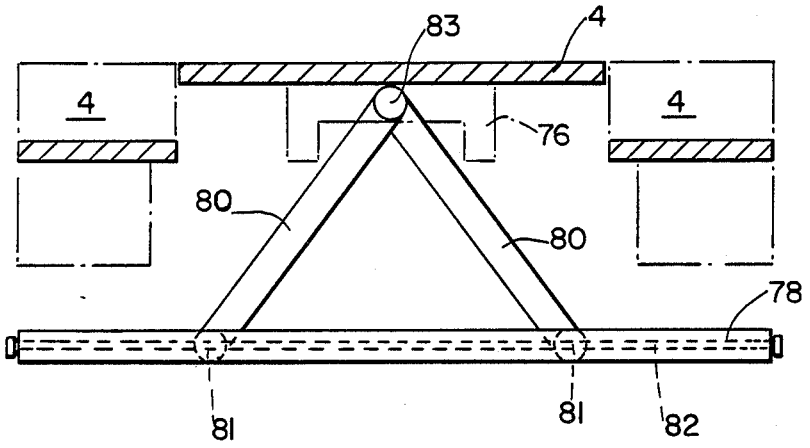
Figure 10:
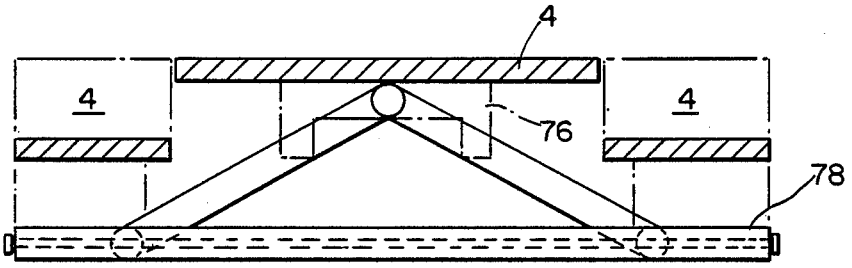
Figure 10:
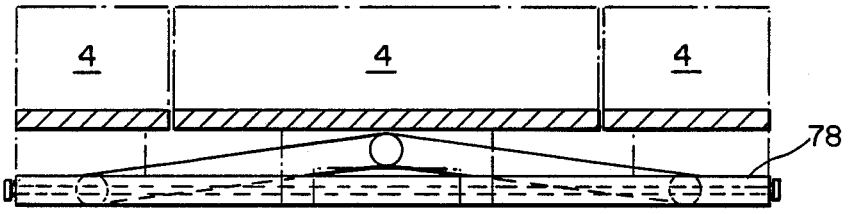
Figure 11:
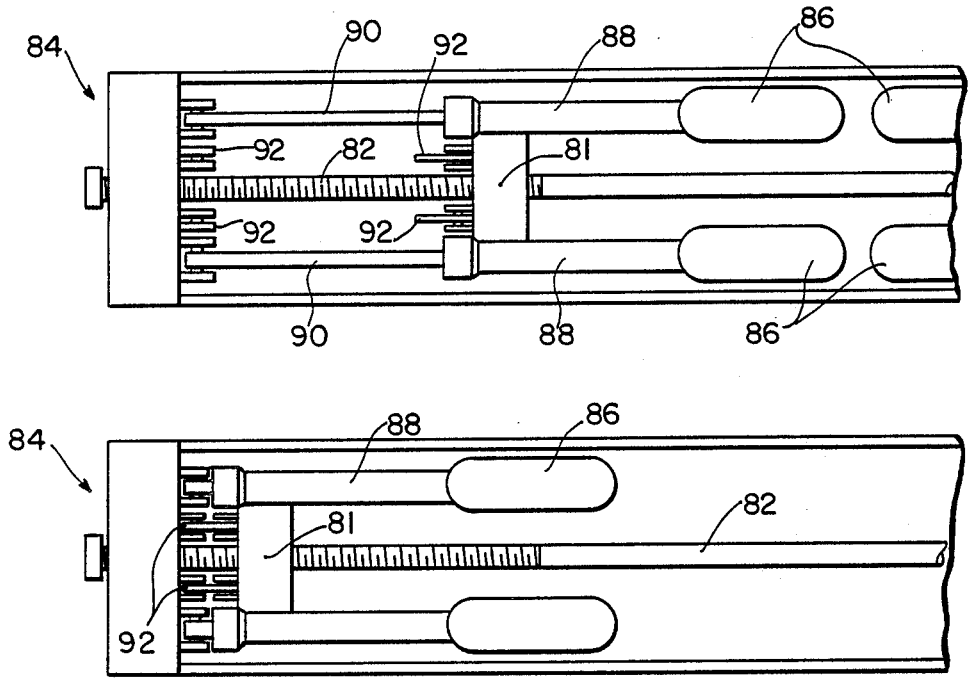
Figure 12:
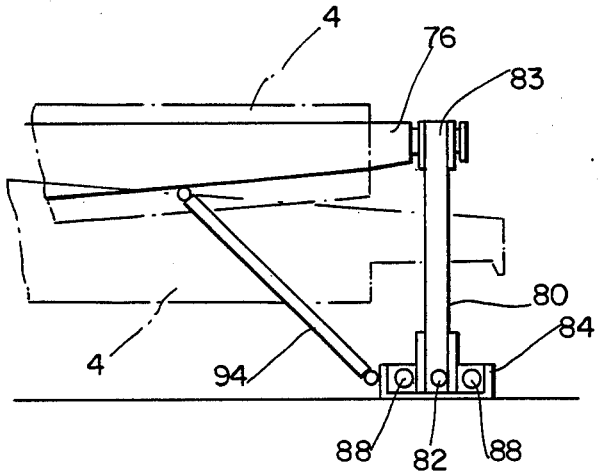

FIG. 3 shows a cross-section of a bridge of the invention with cable reinforcement, FIG. 4 shows the loading of a bridge section of the invention onto a transport vehicle, FIG. 5 shows the unloading of a bridge section of the invention from a transport vehicle, FIG. 6 shows the launching action using the BIBER launching equipment and a crane, FIG. 7 is a special launching vehicle, FIG. 8 shows the launching using the launching vehicle or FIG. 7, FIG. 9 shows the launching action with one embodiment of the bridge of the invention, and FIGS. 10 through 12 are embodiments of a traversing beam ramp section with bank beams.

DETAILED DESCRIPTION

Figure 1:
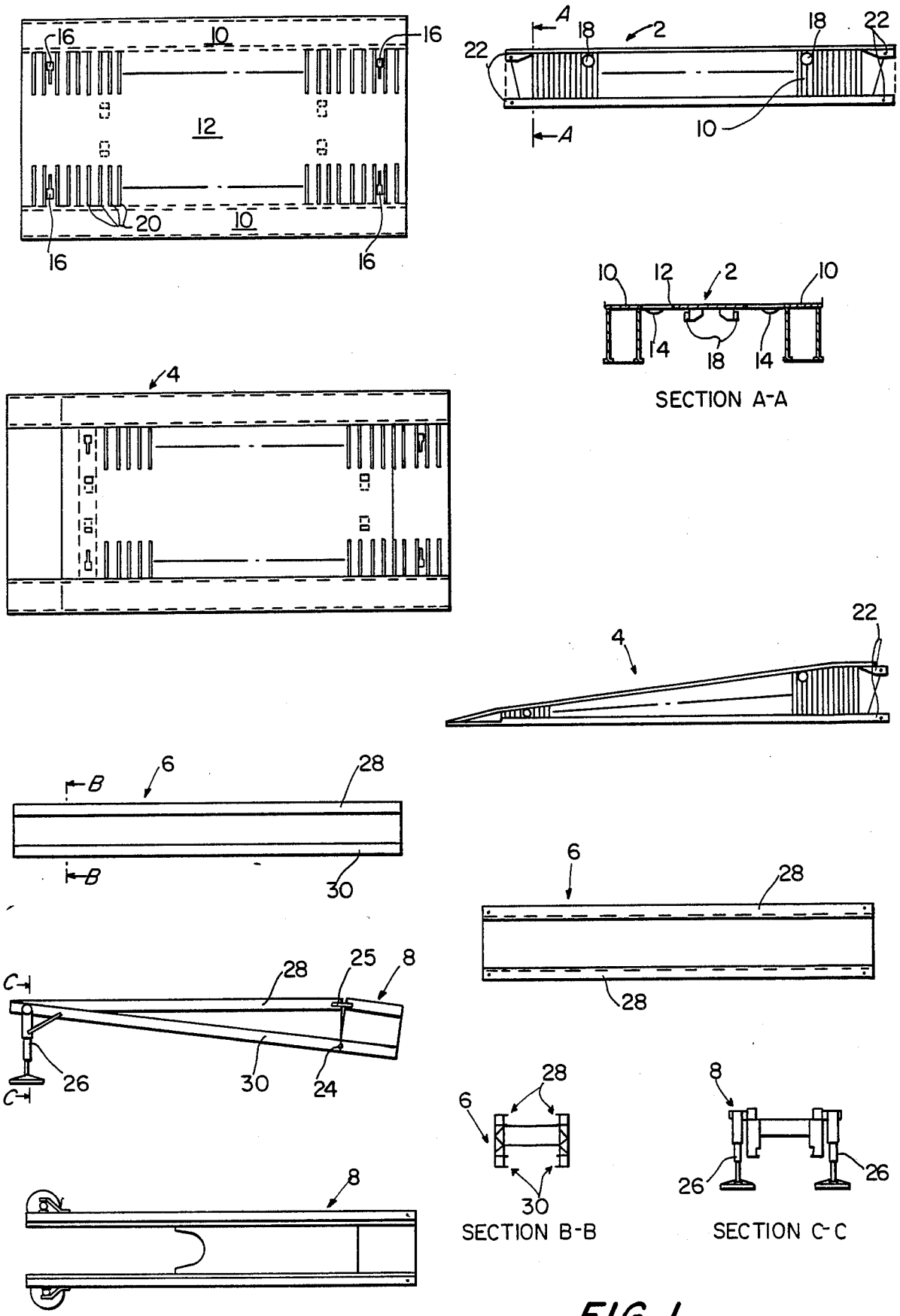
FIG. 1 shows the parts of a bridge of the invention.

FIG. 1 shows an interior bay 2, a ramp bay 4, a traversing beam inner section 6 and a traversing beam ramp section 8 as seen from several directions. The section 2 shows the two side parts 10 and the center part 12 which mutually connect by hinge means 14 and locking means 16, further the bridge rollers 18 to guide the section 2 on the traversing beam, the lattices 20 and the couplings 22. The traversing beam ramp section 8 is movable by means of the hinges 24 and the shackles 25 and it contains two hydraulically advancing traversing beam feet 26 which can be retracted, and two rails 28 and 30 both at the top and at the bottom.

Figure 2:
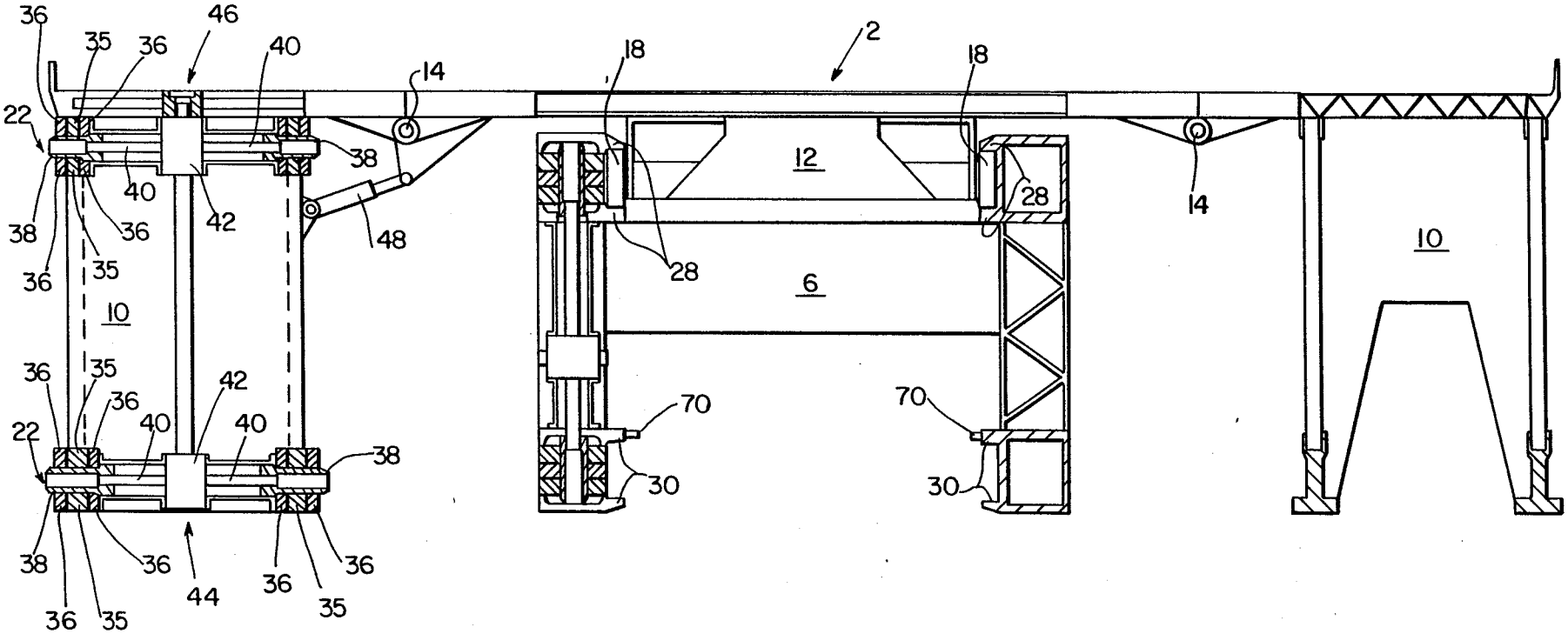
FIG. 2 shows a cross-section of a bridge of the invention.

FIG. 2 is a cross-section of the parts 2 and 6 of FIG. 1. The essentially H-shaped traversing beam 6 can be seen below the central part 12, the two upper rails 28 of the truss 6 receiving the bridge rolls 18. The two lower rails 30 receive the guide rolls 32 of a bridge launching equipment 34 which will be described further below. The individual bridge sections 2, 4 are connected by displaceable bolt couplings 22. Shackles 35 of the adjacent section extend as far as the forks 36 of the upper and lower chords at the couplings 22 and are connected by the bolts 38. This is performed by turning out the bolts 38 on the spindles 40 driven by two power drives 42. The rotational drive can be selected to be either from below at point 44, for instance hydraulically applied to the bridge launching equipment 34, or for instance manually from above at point 46. The drive points 44, 46 are the points permitting introduction of a rotational motion into the locking gear. A simple and obvious embodiment, for instance, would be countersunk rectangular bars rotated by applying a correspondingly shaped key, i.e., a socket wrench or button die. This wrench can be applied from above at point 46, for instance by a soldier with a monkey wrench, or from below at point 44 when the bridge part still rests on the launching vehicle. In the latter case, the monkey wrench could be motor-driven.

The power or gear drives 42 distribute the rotation introduced at the drive points 44, 46 to the bolts 38 locking a particular bridge part to an abutting bridge part. A simple design would be, for instance, three spur gears in each case, which transmit a rotation introduced at point 46 to the two spindles 40.

The bolts 38 are mounted on the spindles 40 and move inwardly or outwardly as the spindles rotate. The bolts 38 lock the shackles 35 of an adjacent segment in the forks 36 of their own bridge part. Thus, this coupling takes place by advancing one bolt 38 from four points each of every side part while the four shackles 35 of the matching bridge part are kept in place in the forks 36. FIG. 2 clearly shows, on the left side, that there is ample space for moving the bolts 38 in and out and, therefore, they can lock the bridge parts or release them. The bolt lock system discussed above is not an object of the present invention but rather it represents the general state of the art. The individual sections 6, 8 of the traversing beam are connected correspondingly. To avert mechanical impacts when unfolding or collapsing the sections 2 or 4, damping means 48 are provided, which further can be spring loaded.

FIG. 3 shows a cross-section of a bridge of the invention with cable reinforcement (intermediate trestle). Reinforcement by one or more cables increases the load capacity and the span of the bridge. The high tensional stresses in the reinforcement cables 50 when the bridge is loaded cause high compressions on the retractable posts 52. The posts 52 are kept at fixed distances by the cross-beams 54; the cross-cables 56 prevent the posts 52 from buckling.

FIG. 4 shows the loading of individual bridge bays 2. The locking means 16 are loosened and the hoisting device 58 of a crane 60 is connected to the central part 12. Once the section 2 is raised, the side parts 10 by their own weight tip partly underneath the central part 12. When the bay 2 is lowered onto the smooth loading surface 62 of transport vehicle 64, the side parts 10 will entirely slip underneath the central part 12. If two bridge bays 2 are loaded on a conventional truck 64, the loading size will be 2.5 m wide and 3.5 m total height and therefore permissible for road use. Only coarse cleaning of the partly self-cleaning central parts 12 is required prior to dismantling the bridge. Soil on both the side parts 10 drops off by itself or can be easily removed later when these parts are loaded.

FIG. 5 shows the unloading procedure for individual bridge bays 2. To that end, the hoisting device 58 is mounted to the side parts 10. When lifting takes place, the bay 2 automatically snaps open; undesired shocks are prevented by the damping means 48, omitted here from the drawing. The locking can be performed automatically by means of a snap closure means or by hand.

The automatic snap open or shut operation of the bridge parts takes place by means of the selection of the lifting points and by gravity, as shown in FIGS. 4 and 5. As shown in FIG. 4, when snapping shut, the hoisting device 58 will be fixed to the bridge central part 12. When the hinges between the parts 12 and 10 are unlocked and the hoisting device 58 is raised, the side parts 12, by their own weight, fall into the position shown in the second diagram of FIG. 4. As the bridge part is further lowered onto the smooth loading surface 62 of a transport vehicle 64, the resting edges of the side parts 10 slip inwardly because the weight of the central part 12 engages the hinges which are further outside and thereby generates a locking torque.

As shown by FIG. 5, the automatic snap-open operation is implemented by selecting other lifting points. The hoisting device 58 is fixed not to the central part 12 but, rather, at the side parts 10. As shown by the traction cables in the left diagram of FIG. 5, the hoisting device 58, which is wider than the central part, transmits a force component acting toward the outside and opening the bridge part during the raising operation. After they are raised, the side parts 10, by means of their own weight, swing into the position shown in the third diagram of FIG. 5.

This automatic snapping shut or open decreases the number of required crane motions and hence the time needed to emplace or dismantle the bridge as compared to the known designs, and in a substantial manner.

FIG. 6 shows an emplacement procedure using the known BIBER tracked launcher 34 and a commercial (4 ton) crane 60. The launching equipment 34 moves to the terrain depression and advances its fulcrum system 66. A traversing beam ramp section 8 already is on the launching equipment on the guide rollers 32 of the boom 68. A gear in the boom 68 advances the part 8 along its racks (FIG. 2 shows one tooth 70 in each case). The traversing beam feet 26 are snapped out and advanced hydraulically. The crane 60 handles internal sections 6 of traversing beam which are coupled together and are moved forward on their lower rails 30. Once the traversing beam is of the proper length, a second traversing beam ramp section 8 will be coupled thereto. Now the traversing beam is complete and is held only by the rollers 32. Due to the weight of the traversing beam being low, this can be done for adequate spans. The traversing beam is made to rest on its feet 26 by lowering the boom 68. In this process, the two traversing beam ramp sections fold up, whereby presently the upper rails 28 rather than the lower rails 30 form straight lines. The straight lines, whether on the upper or lower side of the traversing beam, are generated by the fact that the ramp parts of the traversing beam can fold on themselves and by that angle subtended by the tip of the foot of the traversing beam. This folding can be implemented by a mere hinge or shackle means. The simplest solution is a shackle rotatably fastened on one side and including an elongated slot on the other side within which a bolt form the other ramp part of the traversing beam can move to and from. If a ramp part of the traversing beam rests on a smooth surface (FIG. 1), the two parts snap apart and a wedge-shaped gap is formed therebetween. If, on the other hand, the ramp part of the traversing beam is supported at both ends but not at its center (FIG. 2), the two parts snap together, the gap disappears, and a flat rail is formed at the top. The launching equipment 34 now can be moved away or be used elsewhere or for other ends. Now the crane 60 lifts a ramp bay 4 and introduces its rollers 18 into the upper rails 28 of the traversing beam. Bridge interior bays 2 then are connected and are pulled, for instance by means of a cable and reversing roller (omitted), over the traversing beam. Again, the last member is formed by a ramp bay 4. The traversing beam feet 26 are retracted and collapsed. The bridge is ready for traffic without having to dismantle construction components. The traversing beam remains within it and contributes to operation. Dismantling takes place in the precisely opposite sequence and can be carried out from either side.

FIG. 7 shows a launching vehicle 72 replacing the BIBER 34 tracked launcher and the crane 60. A boom 68 corresponding to that of the equipment 34 and a 4-ton crane 60 are mounted offset from the center on the frame of a known 10-ton truck 64 with fulcrum system 74.

FIG. 8 shows a launching procedure using the launching vehicle 72 shown in FIG. 7. The procedure corresponds to that shown in FIG. 6 and accordingly will be described only briefly.

The vehicle 72 already has been loaded with two traversing beam ramp sections 8 and is depositing one of them. The boom 68 is moved to the rear. The traversing beam ramp section 8 is moved to the rear on rollers 32, coupled to traversing beam inner sections 6 and is moved back further. A second ramp section 8 completes the traversing beam. It is deposited and bridge bays 2, 4 are made to move over it. When the bridge is completed, the traversing beam feet 26 are retracted and collapsed. The bridge is ready for traffic.

As regards the launching procedure of the invention shown in FIG. 9 for still larger spans, the invention is modified with respect to the procedure shown in FIG. 8 to the extent that the rails 28, 30 are no longer mounted to the traversing beam 6, 8 but rather to the boom 68 and to the bridge bays 2, 4. To that end the corresponding rollers 18, 32 are mounted to the traversing beam 6, 8. Due to this step the traversing beam can be made still lighter.

FIG. 10 shows an embodiment of a traversing beam ramp section 76 which can be alternatively used as the traversing beam ramp section 8. In lieu of the traversing beam feet 26, a bank beam 78 is mounted by means of the scissors 80 to the traversing beam ramp section 76. A spindle 82 is provided in the bank beam 78. By rotating the spindle, the scissors 80 (articulating points 81, 83) can be spread and the traversing beam ramp section 76 then can be lowered. FIG. 10 at the top shows the traversing beam ramp section 76 in the raised position with the bridge ramp bay 4. The fore edges of the track are shown shaded. FIG. 10 at the center shows the position where the bridge has been lowered to such an extent that the truckways of the bridge ramp 4 have been deposited on the bank beam 78. The final position is shown at the bottom of FIG. 10. The scissors has been fully spread. The traversing beam tips and the ramp center section now are completely lowered. The steps caused by the bank beam at every bridge head are spanned by laying (omitted) drag-ramps.

FIG. 11 shows an embodiment of a bank beam 84 with hydraulic reservoirs, as seen from above. The bank beam 84 contains, in addition to the spindle 82, also two hydraulic reservoirs communicating in parallel, with supply vessels 86, cylinders 88 and piston rods 90.

The articulating point 81 of the scissors arms is rigidly connected with the cylinders 88. The piston rods 90 are rigidly joined to the bank beam 84.

The top of FIG. 11 shows the bank beam 84 in the lifted position (corresponding to the top of FIG. 10). The pistons are fully advanced, and the gas in the supply vessels 86 is at a relatively minor pressurization. The bottom of FIG. 11 shows the pistons fully retracted (corresponding to the bottom of FIG. 10). The hydraulic liquid of the cylinders 88 now has highly pressurized the gas in the supply vessels 86. The bridge is additionally secured by a mechanical locking means 92. In this manner the potential energy of the bridge can be stored when it is being lowered. When dismantling, the stored gas pressure assists in raising the bridge more rapidly.

FIG. 12 shows a bridgehead with bank beam 84, as seen from the side, and in the raised state (corresponding to the top of FIG. 10). The traversing beam ramp section 76 is borne by the bank beam 84 with the spindle 82 and the second cylinder 88 by means of the scissors 80. The bridge ramp bay 4, with the central part resting above and the two hanging side parts, rests on the traversing beam. Two struts 94 between the traversing beam ramp section 76 and the bank beam 84 prevent warping in the articulation 83 for the jacked-up state. The struts 94 are removed at the top and laid on the ground prior to lowering.

The embodiments with the bank beams offer the following advantages over the solutions using feet:

improved standing stability,
lower resting pressure,
specific emplacement conditions,
balancing of unevenness,
lesser slopes due to the approach extended by the drag ramps, and
easier assembly and dismantling by energy storage.

It will be obvious to those skilled in the art that many modifications may be made within the scope of the present invention without departing from the spirit thereof, and the invention includes all such modifications.

What we claim is:

1. In a solid or dry bridge kit, composed of individual bridge bays with a U-shaped cross-section and a cross-sectionally H-shaped traversing beam, the improvement comprising; the bridge bays (2,4) each comprise a central part (12) and two side parts 10, said side parts containing track ways in the shape of hollow boxes; hinge connector means for hingedly connecting the two side parts to the central part, so that the two side parts (10) can be folded by 90° under the central part (12), whereby upper surface of said side parts are perpendicular to an upper surface of said central part (12) for purposes of transport;

the traversing beam as assembled providing support for the individual bridge bays (2,4) as coupled together and moved over said traversing beam, the traversing beam connected to one of the bridge bays to remain a support element in the bridge.

2. A dry bridge kit according to claim 1 including hoisting points so arranged in the bays (2,4) so that during dismantling the side parts (10) automatically fold underneath the central part (12) when the structures are raised, and during assembly the snap open underneath the central part (12).

3. A dry bridge kit according to claim 1 in which the bays (2,4) in part comprise lattices and bridge means connected to the bridge.

4. A dry bridge kit according to claim 1 including a BIBER tracked launcher (34) and a crane (60) for launching of the body.

5. A dry bridge kit according to claim 1 including a special launching vehicle (72) with boom (68) and crane (60).

6. A dry bridge kit according to claim 5 in which the traversing beam comprises two upper rails (28) and two lower rails (30), and the boom and the bridge bays are provided with fitted rollers (18, 32).

7. A dry bridge kit according to claim 5 in which the traversing beam includes rollers, and the boom and the bridge bays include fitted rails.

8. A dry bridge kit according to claim 1 in which individual traversing beam sections (6, 8) and bridge bays (2, 4) are connected by slip-in bolt couplings (22), driven by various drive points (44, 46), by means of gear drives (42).

9. A dry bridge kit according to claim 8 in which the drive is hydraulic.

10. A dry bridge kit according to claim 6 in which the traversing beam includes ramp sections (8) so mutually collapsible by means of hinges (24) and shackles (25) that one of the upper rails (28), and the lower rails (30), form straight lines.

11. A dry bridge kit according to claim 1 in which a bank beam (78, 84) is mounted by one scissors (80) each to traversing beam ramp sections (76), the tips of bridge ramp bays (4) and the tips of the traversing beam ramp sections (76) resting in the lowered position on said bank beam (78, 84).

12. A dry bridge kit according to claim 11 including a hydraulic-pneumatic reservoir for storing potential energy during lowering.

13. In a solid or dry bridge kit, composed of individual bridge bays with a U-shaped cross-section, the improvement comprising, said bridge bays each comprise a central part and two side parts, said side parts containing track ways in the shape of hollow boxes;

means for hingedly connecting respectively long edges of the two side parts to long edges of the central part so that the two side parts can be folded by 90° under the central part whereby upper surface of said side parts are perpendicular to an upper surface of said central part (12) for purposes of transport;

first hoisting points on the side parts of each bridge bay so that upon hoisting the side parts automatically fold up from under the central part on deployment; and second hoisting points on the bay bridge for providing, on hoisting, for automatic folding of the side parts under the central part.

14. Dry bridge kit according to claim 13 in which the bridge bays are at least partially constructed as lattice structure there being bracing means connected for bracing the bridge as a whole.

15. Dry bridge kit according to claim 13 including hoisting means for connection to the first hoisting points to obtain the fold up of the side parts, and to the second hoisting points to obtain the folding of the side parts under the central part.

16. In a solid or dry bridge kit which includes bridge erecting facilities and bridge elements, the elements including respectively individual bridge bay elements with a U-shaped cross-section, the improvement comprising in combination;

the bridge bay elements each comprise a central part and two side parts, said side parts containing track ways in the shape of hollow boxes;

means for hingedly connecting the two side parts to the central part respectively along long edges so that the two side parts can be folded by 90° under the central part whereby upper surfaces of said side parts are perpendicular to an upper surface of said central part for purposes of transport;

first hoisting means to be attached to particular hoisting points of one of the bridge bay elements during launching of the bridge so that the side bars fold up;

second hoisting means to be attached to different hoisting points of the latter bridge bay element for folding the side parts under the central part on hoisting.

* * * * *